US006239375B1

(12) United States Patent
Shinchi

(10) Patent No.: US 6,239,375 B1
(45) Date of Patent: May 29, 2001

(54) TERMINAL FOR CONNECTION BY ULTRASONIC WAVE AND A STRUCTURE THEREFOR

(75) Inventor: Akira Shinchi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/004,510

(22) Filed: Jan. 8, 1998

(30) Foreign Application Priority Data

Jan. 9, 1997 (JP) ..... 9-002298

(51) Int. Cl.[7] ..... H01R 9/03
(52) U.S. Cl. ..... 174/88 R
(58) Field of Search ..... 174/84 R, 88 R, 174/84 C, 92; 439/656, 874

(56) References Cited

U.S. PATENT DOCUMENTS

| | | | | |
|---|---|---|---|---|
| 3,129,995 | * | 4/1964 | Brown | 174/84 C X |
| 3,137,925 | * | 6/1964 | Wahl | 174/84 C X |
| 3,145,261 | * | 8/1964 | Forney, Jr. | 174/84 C |
| 4,442,316 | * | 4/1984 | Thuermer | 174/84 C |
| 5,094,636 | | 3/1992 | Zinn et al. | 439/839 |
| 5,134,249 | * | 7/1992 | Adachi | 174/84 R X |
| 5,397,251 | | 3/1995 | Kaminski | 439/620 |
| 5,857,259 | * | 1/1999 | Johnston | 29/858 |
| 5,947,770 | * | 9/1999 | Shinchi | 439/656 |

FOREIGN PATENT DOCUMENTS

| | | |
|---|---|---|
| 0 678 936 A1 | 10/1995 | (EP) . |
| 9800190 | 5/1998 | (GB) . |
| 7-70345 | 7/1995 | (JP) . |

* cited by examiner

*Primary Examiner*—Dean A. Reichard
*Assistant Examiner*—Chau N. Nguyen
(74) *Attorney, Agent, or Firm*—Finnegan, Henderson, Farabow, Garrett & Dunner, L.L.P.

(57) ABSTRACT

A terminal for ultrasonic wave connection is to be nipped between a first member and a second member, while a covered wire having core elements and a cover portion covering external circumference thereof is stacked on the terminal. The cover portion is melted by applying ultrasonic vibration, while the first and second members are pressed, so that the terminal and core elements are conductively contacted with each other. The terminal includes a relief portion for releasing the melted cover portion. The relief portions are provided at a portion to which the covered wire is to be connected.

8 Claims, 5 Drawing Sheets

TERMINAL FOR CONNECTION BY ULTRASONIC WAVE AND A STRUCTURE THEREFOR

BACKGROUND OF THE INVENTION

1. Field of the Invention

This invention relates to a terminal for connection by ultrasonic wave, which is to be conductively connected to a covered wire by ultrasonic wave energy, and a structure therefor, wherein a covered wire is to be connected to a terminal by ultrasonic wave energy.

2. Description of Relevant Art

This kind of art has been disclosed in, for example, Japanese Patent Publication No. 7-70345. FIGS. 1A–1D illustrate the art. FIG. 1A shows a first member 1 and a second member 2. Both the members 1, 2 are formed of material (plastic) which can be fused by ultrasonic vibration. The first member 1 contains groove portions 3 and the second member 2 includes protrusions 4 which engage the groove portions 3.

FIG. 1B shows a terminal 7 contained in a groove portion 3 and a covered wire 8 placed on the terminal 7. On a bottom face of the groove portion 3 are small concave portions 3*a* and on a top face of the corresponding protrusion 4 are provided small protrusions 4*a* which engage the small concave portions 3*a*.

According to this art, as shown in FIG. 1C, the terminal 7 is contained in the groove portion 3 and the covered wire 8 is placed thereon. After that, the second member 2 is mounted on a top face of the first member 1 so that the protrusions 4 are inserted into the groove portions 3. Then, ultrasonic vibration is applied while a pressing force is applied between the first and second members 1, 2, so that a cover portion of the covered wire 8 nipped between the protrusion 4 and the groove portion 3 is melted thereby making the core elements of the covered wire 8 into conductive contact with the terminal 7. At the same time, the first and second members 1, 2 are welded to each other by ultrasonic fusion so that an integrated connection structure as shown in FIG. 1D is obtained, whereby core elements of the covered wire 8 are connected to the terminal 7.

However, according to the aforementioned art, as shown in FIG. 2, the melted cover portion 8*b* escapes into gaps between the groove portion 3 and side faces of the protrusion 4. At this time, some of the core elements 8*a* escape sideways together with the melted cover portion 8*b*, so that excellent conductive contact between the core elements 8*a* and terminal 7 is lost.

As a countermeasure, as shown in FIG. 3, a method of eliminating the gap between the groove portion 3 and the protrusion 4 can be considered. However, if the side faces of both the groove portion 3 and protrusion 4 are in contact with each other, ultrasonic wave is not transmitted excellent to a target position (covered wire 8 on the terminal 3) so that processing efficiency may drop. Further, because escape place of the melted cover portion 8*b* exists only in the length direction of the groove portion 3, engagement between the first and second members 1, 2 becomes incomplete, so that excellent conductive contact between the core elements 8*a* and terminal 7 may be lost.

SUMMARY OF THE INVENTION

Accordingly, it is an object of the present invention to provide a terminal for connection by ultrasonic wave, wherein an excellent connection with core elements can be obtained securely without decreasing processing efficiency, and a structure therefor.

To achieve the object, a first aspect of the invention provides a terminal for ultrasonic wave connection, which is to be nipped between a first member and a second member while a covered wire comprising core elements and a cover portion covering external circumference thereof being stacked on the terminal, wherein the cover portion is melted by applying ultrasonic vibration while the first and second members being pressed, so that the terminal and core elements are conductively contacted with each other, the terminal including a relief portion for releasing the melted cover portion, the relief portion being provided at a portion to which the covered wire is to be connected.

According to the first aspect, the cover portion melted by ultrasonic vibration escapes into the relief portion formed in the terminal positively. Therefore, an excellent contact between the terminal and core elements can be obtained.

To achieve the object, a second aspect of the invention provides a terminal for ultrasonic wave connection according to the first aspect wherein concave portions and convex portions are formed on a sheet surface on which a covered wire is to be stacked, of a portion to which the covered wire is to be connected, the relief portion being the concave portion.

According to the second aspect, relief portions are formed on a sheet surface on which the covered wire is to be stacked. Thus the core elements become difficult to be turned together with the melted cover portion into the gaps between the groove portion of the first member and side faces of the second member. Further, because the melted cover portion gathers in the relief portions, the top face of the concave portion becomes more likely to contact the core elements. Further, because ultrasonic wave energy is concentrated on the concave portion of the terminal, the cover portion becomes easier to melt. Because the concave portion and convex portion can be formed easily by serration processing, this structure can be realized easily.

To achieve the object, a third aspect of the invention provides a terminal for ultrasonic wave connection according to the second aspect wherein a plurality of concave portions and convex portions are formed in parallel to each other in a direction perpendicular to a direction in which the covered wire extends.

According to the third aspect, the terminal is in contact with a top face of the convex portion while crossing over the concave portion. Thus, an excellent conductive contact between the core elements and terminal can be obtained without being obstructed by the melted cover portion.

To achieve the object, a fourth aspect of the invention provides a terminal for ultrasonic wave connection according to the first aspect wherein a portion to which the covered wire is to be connected comprises a bottom wall on which the covered wire is to be placed and vertical walls raised from side edges of the bottom wall, having a cutout portion, the relief portion being the cutout portion.

According to the fourth aspect, the cover portion melted by ultrasonic vibration escapes through the cutout portions so that it is displaced from above the terminal. That is, when ultrasonic vibration is applied between the groove portion of the first member and the protrusion of the second member with the terminal and covered wire being nipped therebetween, a space inside the terminal and a space outside the terminal (the gap between the groove portion and the terminal) is separated by the terminal having the vertical walls. However, those spaces communicate with each other through the cutout portions provided in the vertical walls. Therefore, the cover portion melted inside the terminal is displaced into a space outside the terminal also through the cutout portions. Consequently, there is provided a space to which the melted cover portion is to be released. Further, due to the presence of the vertical walls, when melted cover portion escapes sideways with a tendency to carry core elements, the core elements are brought into abutment with the vertical walls, whereby they are prevented from being laterally deformed over there. Further, because of invasion of the melted cover portion into space sideways, a possibility of looseness between the terminal and groove portion (first member) is eliminated.

To achieve the object, a fifth aspect of the invention provides a terminal for ultrasonic wave connection according to the fourth aspect wherein a plurality of terminals are formed in an extending direction of the covered wire.

According to the fifth aspect, because a plurality of cutout portions are formed in an extending direction of the covered wire, the melted cover portion escapes smoothly into the cutout portions and further outside the vertical walls. Thus, a conductivity between the core elements and terminal can be improved.

To achieve the object, a sixth aspect of the invention provides a structure for connecting the terminal for ultrasonic wave connection according to any one of the first to the fifth aspect to the covered wire by ultrasonic vibration, wherein the terminal is contained in each of groove portions provided in the first member, a covered wire is placed on the terminal so as to be stacked thereon, then the second member is mounted on the first member so that protrusions provided on the second member are inserted into the groove portions, the first and second members are pressed so as to apply a force between the protrusions and groove portions and at the same time, ultrasonic vibration is applied thereto so as to melt the cover portion of the covered wire and part of the melted cover portion is released to the relief portion, so that the cover portion of the covered wire and terminal are conductively contacted with each other.

According to the sixth aspect, the melted cover portion is released positively to the relief portions formed in the terminal. Thus, an excellent contact condition with the core elements can be obtained, thereby raising a reliability of electrical connection.

To achieve the object, a seventh aspect of the invention provides a structure for connecting by ultrasonic vibration according to the sixth aspect wherein the first member is a terminal holding portion formed at an end of a connector housing body so as to protrude and the second member is a cover body for clogging the terminal holding portion.

According to the seventh aspect, the covered wire and terminal can be connected to each other by ultrasonic vibration and at the same time, an integrated connector can be formed.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIGS. 1A, 1B, 1C, 1D are explanatory views for explaining the prior art, while FIG. 1A is a perspective view showing a structure between a first member and a second member, FIG. 1B is a longitudinal sectional view showing a state in which a terminal and a covered wire are contained in a groove portion of the first member, FIG. 1C is a front view of the same state and FIG. 1D is a longitudinal sectional view showing a state in which the connection is completed;

Figure 4A:
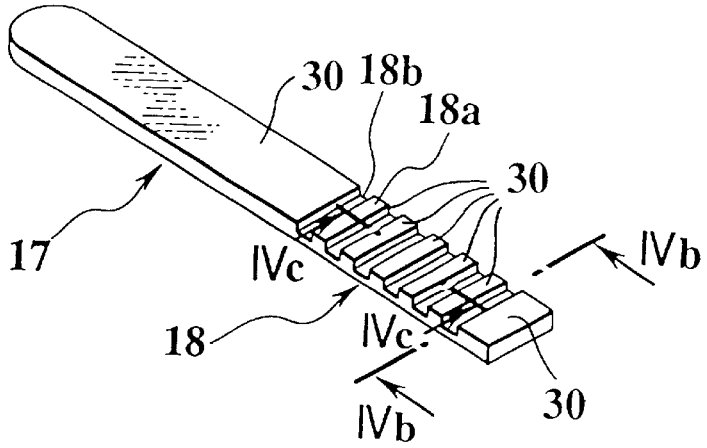
Figure 4B:
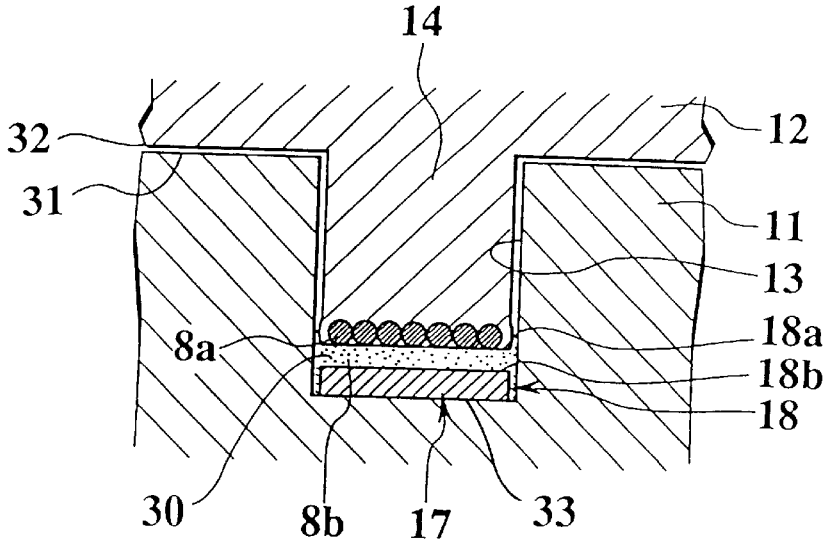
Figure 4C:
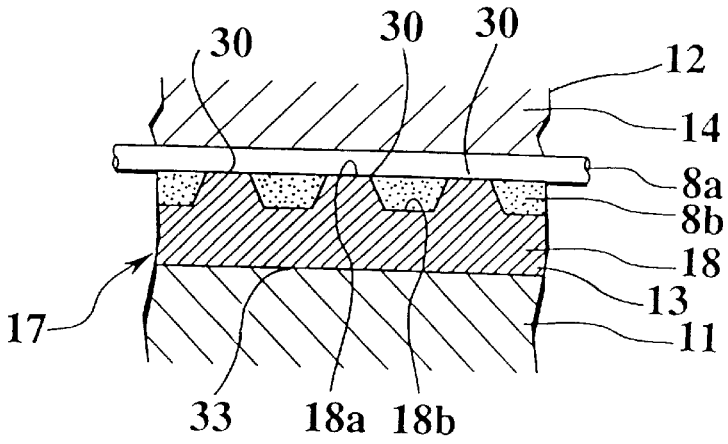
Figure 5:
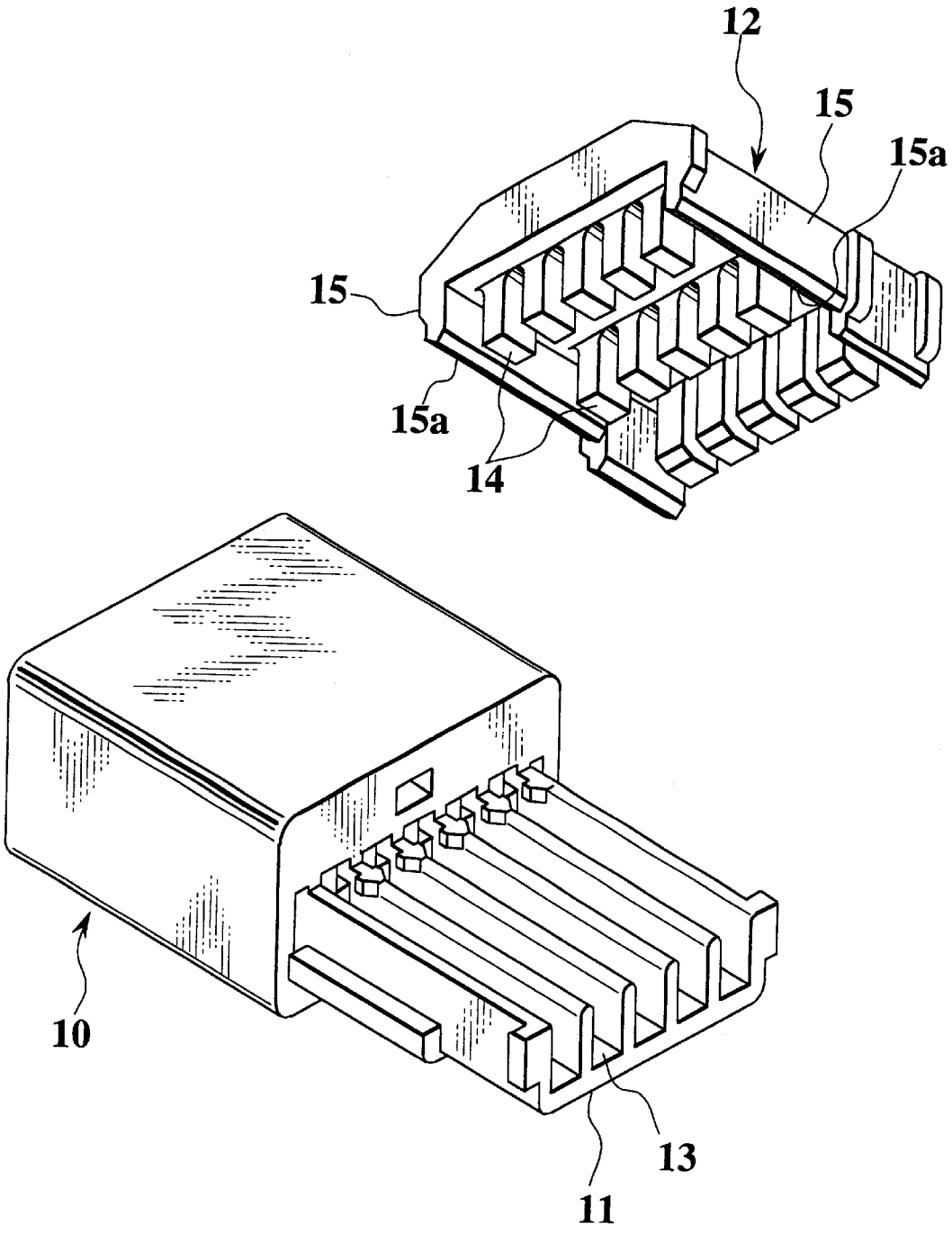
Figure 6A:
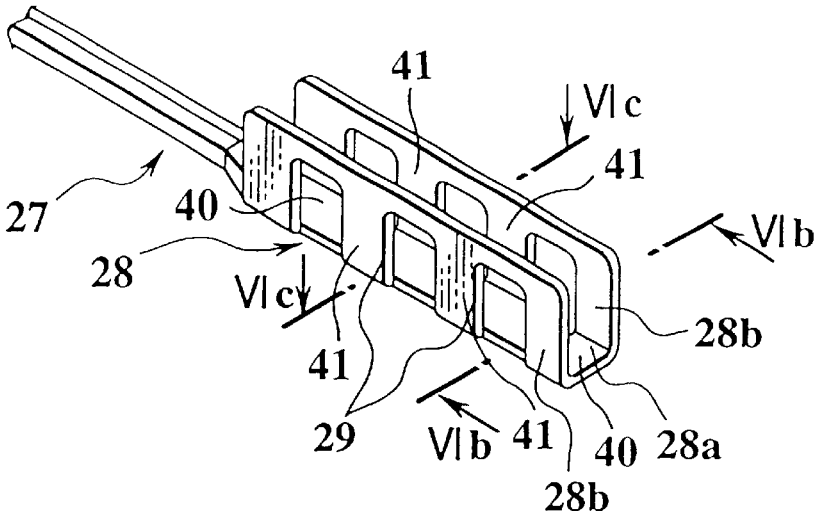
Figure 6B:
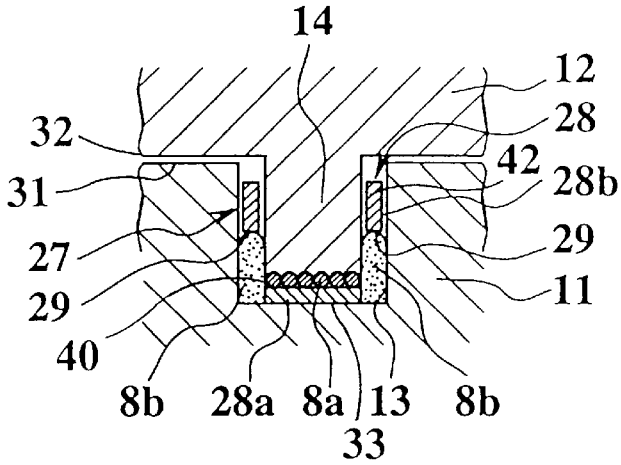
Figure 6C:
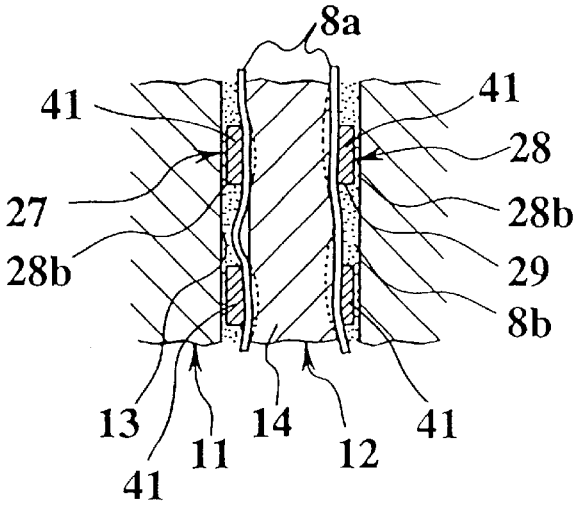

FIGS. 4A, 4B, 4C are explanatory views for explaining an embodiment of the present invention, while FIG. 4A is a perspective view showing a structure of a terminal, FIG. 4B is a sectional view of a connection portion between core elements of a wire and the terminal, taken along the line Nb—Nb of FIG. 4A, and FIG. 4C is a sectional view of the connection portion between the wire and the terminal taken along the line Nc—Nc of FIG. 4A;

FIG. 5 is a perspective view of a connector housing body (first member) and a cover body (second member) according to the embodiment of the present invention; and FIGS. 6A, 6B, 6C are explanatory views of another embodiment of the present invention, while FIG. 6A is a perspective view showing a structure of a terminal, FIG. 6B is a sectional view of a connection portion between core elements of a wire and the terminal taken along the line Vlb—Vlb of FIG. 6A, and FIG. 6C is a sectional view of the connection portion between the wire and the terminal taken along the line Vlc—Vlc of FIG. 6A.

DETAILED DESCRIPTION OF THE PREFERRED EMBODIMENTS

The contents of U.S. Pat. No. 5,584,122 are incorporated herein by reference.

There will be detailed below the preferred embodiments of the present invention with reference to the accompanying drawings. Like members are designated by like reference characters.

FIGS. 4A to 4C explain a connection structure and method according to a first embodiment of the present invention, while FIG. 4A is a perspective view showing a structure of a terminal, FIG. 4B is a sectional view of a connection portion between core elements of a covered wire and the terminal, taken along the line lVb—lVb of FIG. 4A and FIG. 4C is a sectional view of the connection portion between the wire and the terminal, taken along the line lVc—lVc of FIG. 4A. FIG. 5 shows a structure of a connector housing including a housing body 10 as a first member and a cover body 12 as a second member.

Referring to FIG. 5, at a rear end portion of the connector housing body 10 is formed a terminal holding portion 11 so as to protrude. Actually this portion 11 serves as a substantial part of the first member. The terminal holding portion 11 contains a plurality of groove portions 13 and the cover body 12 includes protrusions 14 configured to engage the groove portions 13. The connector housing body 10 and the cover body 12 are formed of resin which can be fused by ultrasonic wave. In respect of a front portion of the cover body 12, as shown in FIG. 5, lateral side walls 15 each have a lower edge 15*a* pointed to be pressed onto the terminal holding portion 11, to be fused by ultrasonic wave.

On the other hand, a terminal 17 (ultrasonic wave connecting terminal) for use here is formed entirely in the shape of a sheet as shown in FIG. 4A. A contact surface 30 (sheet surface on which a covered wire is to be placed) of a wire connecting portion 18 (portion to which a covered wire is to be connected) at the rear end thereof is subjected to serration processing so that plural wire connecting portions 18*a* and plural concave portions 18*b* are formed in parallel to each other in a direction perpendicular to an extending direction of the covered wire (length direction of the terminal 17). Each concave portion 18*b* is configured to serve as a relief portion for allowing a melted cover portion 8*b* to escape from above the surface 30 of the wire connecting portion 18 as in FIG. 4B.

Figure 1A:
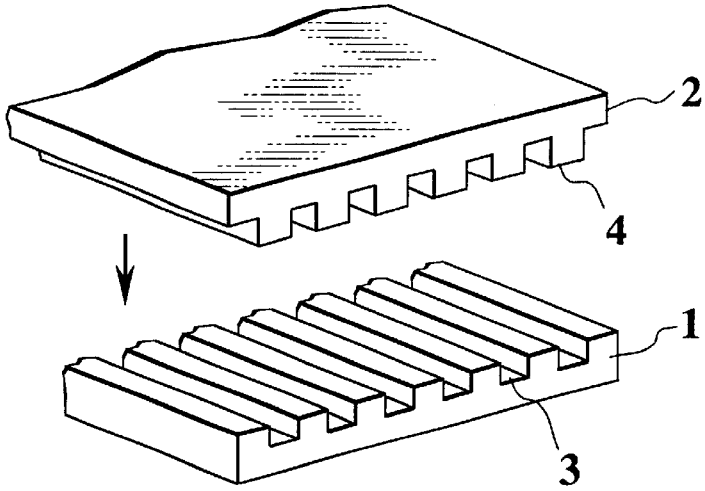
FIG. 1A PRIOR ART
Figure 1B:
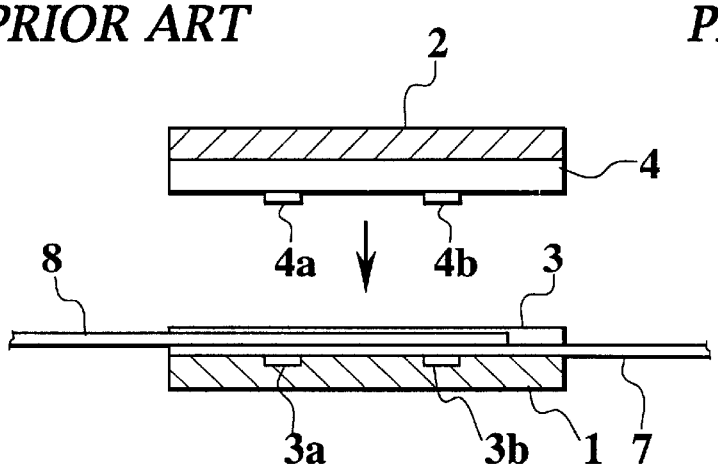
FIG. 1B PRIOR ART
Figure 1C:
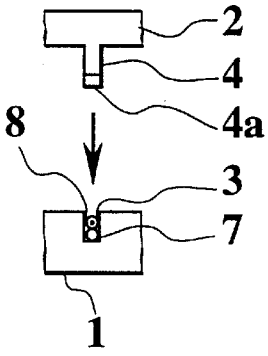
FIG. 1C PRIOR ART
Figure 1D:
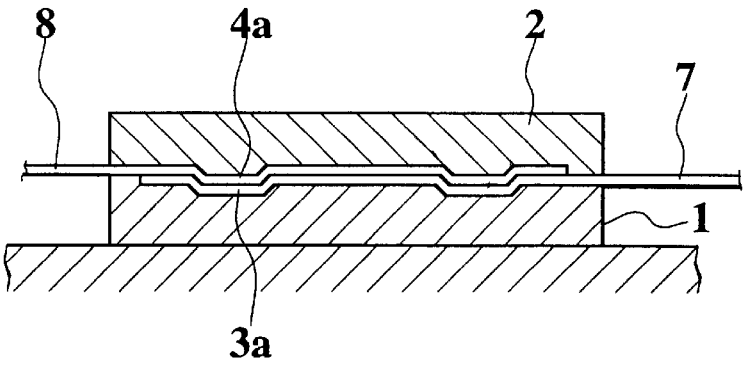
FIG. 1D PRIOR ART
Figure 2:
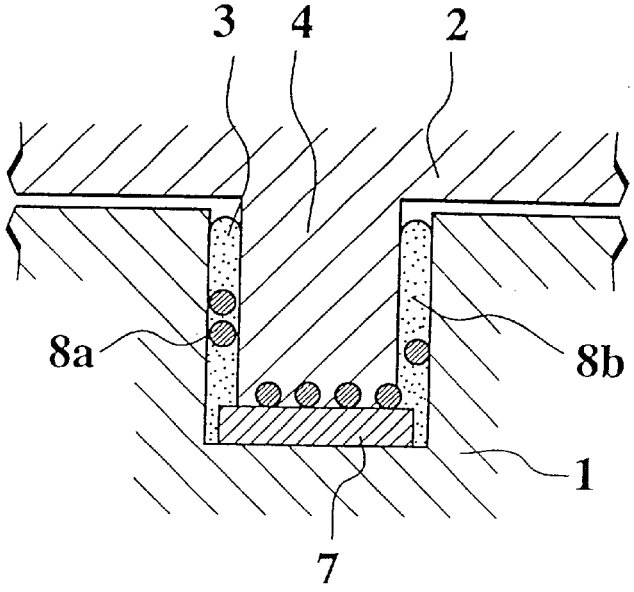
FIG. 2 PRIOR ART
FIG. 2 is a sectional view of a connection portion, originally prepared for use in description of a prior art.
Figure 3:
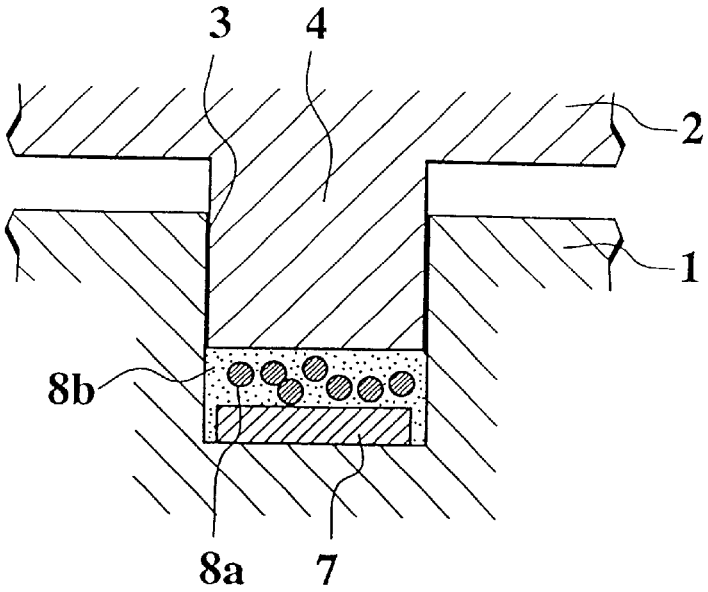
FIG. 3 PRIOR ART
FIG. 3 is a sectional view of a connection portion, originally prepared for use in description of problems of an original substitute configuration for the prior art.

To obtain a connection between the terminal 17 and a covered wire identical to the covered wire (see FIG. 1C) composed of a cover(s), as shown in FIG. 4B, the wire connecting portion 18 of the terminal 17 is contained in a groove portion 13 and portion (before being melted to be 8*b* in FIG. 2) and a bundle of core elements (before coming apart as 8*a* in FIG. 2) coated there in the terminal holding portion 11 of the connector housing body 10 and the covered wire is placed on the convex portions 18*a* and across the concave portions 18*b* of the wire connecting portion 18 of the terminal 17. Then, the cover body 12 is placed thereon so that a protrusion 14 of the cover body 12 is inserted into the groove portion 13 in the terminal holding portion 11. In this condition, an appropriate gap is secured between the cover body 12 and terminal holding portion 11 (e.g., between a top face 31 of the terminal holding portion 11 and a corresponding bottom face 32 of the cover body 12) so as to prevent contact of other portions than the edge 15*a* of each lateral side wall 15 of the cover body 12.

With this condition, the cover body 12 is pressed by an ultrasonic horn so as to apply ultrasonic vibration (applying vertical vibration). Consequently, ultrasonic wave energy is concentrated on the protrusion 14 cooperating with the wire connecting portion 18*a* of the terminal 17 on a bottom 33 of the groove portion 13, so that the cover portion is melted to hold the covered wire therebetween (as 8*b* in FIG. 4B) and then core elements 8*a* are exposed. The melted cover portion 8*b* is expelled from above the terminal 17 under pressure exerted via the protrusion 14, so that the core elements 8*a* and terminal 17 are conductively contacted with each other.

At this time, the melted cover portion 8*b*, as shown in FIG. 4C, escapes into the concave portion 18*b* formed in the terminal 17 positively so that the melted cover portion 8*b* is expelled through gaps between the convex portion 18*a* and core elements 8*a*. Thus, the core elements 8*a* make secure contact with the contact surface 30, i.e., top faces of the plural convex portions 18*a* while crossing over the plural concave portions 18*b* not so as to be obstructed by the melted cover portion 8*b*. Thus, a connection structure having an excellent conductivity performance can be obtained.

Because, in this structure, the relief portion (concave portion 18*b*) for releasing the melted cover portion 8*b* is provided between neighboring convex portions 18*b*, core elements 8*a* abutting on these portions 18*b* are kept from being turned into gaps between the protrusion 19 and side faces of the groove portion 13 unlike the prior art, while the melted cover portion 8*b* is not wholly displaced to the gaps and is partially left in the concave portions 18*b*. From this viewpoint also, the contact performance between the core elements 8*a* and terminal 17 can be improved. Further, because the connector housing body 10 and cover body 12 are used as the first and second members respectively, an integrated connector is produced at the same time when the covered wire 8 and terminal 17 are connected to each other.

Further because ultrasonic wave energy is concentrated on the convex portions 18*a*, the cover portion of the covered wire becomes likely to be melted so as to raise processing efficiency. Further, because the convex portions 18*a* and concave portions 18*b* can be formed easily by serration processing, this connection structure can be realized easily.

Next, another embodiment of the present invention will be described.

FIGS. 6A to 6C explain a connection structure and method according to this embodiment of the present invention, while FIG. 6B is a sectional view of a connection portion between a covered wire identical to what the previous embodiment and a terminal 27, taken along the line Vlb—Vlb of FIG. 6A, and FIG. 6C is a sectional view of the connection portion between the wire and terminal, taken along the line Vlc—Vlc of FIG. 6A. Meantime, first and second members (10 and 12 of FIG. 5) are identical to those of the embodiment described previously.

At a rear portion, the terminal 27 (ultrasonic wave connecting terminal) for use here is formed a wire connecting portion 28 (portion on which the covered wire is to be placed) having a U-shaped cross section, comprising a bottom wall 28*a* on which the covered wire is to be placed and a pair of right and left vertical walls 28*b* raised from both edges of the bottom wall 28*a*. The vertical walls 28*b* have a distance therebetween designed so as to secure a predetermined gap between each wall 28*b* and an opposing side face 42 of a protrusion 14 of a cover body 12 when the protrusion 14 is inserted between the walls 28*b*. The right and left vertical walls 28*b* each have a plurality of substantially rectangular cutout portions 29 formed in an extending direction of the covered wire (length direction of the terminal 27) as a relief portion for releasing a melted cover portion 8*b*.

To obtain a connecting structure of the covered wire and terminal 27, as shown in FIG. 6B, the wire connecting portion 28 of the terminal 27 is contained in a groove portion 13 provided in a terminal holding portion 11 of a connector housing body 10. Then the covered wire is placed on a contact surface 40 of the bottom wall 28*a* of the wire connecting portion 28 of the terminal 27. Then, the cover body 12 is placed thereon so that a protrusion 14 of the cover body 12 is inserted between the vertical walls 28*b* of the wire connecting portion 28 of the terminal 27 placed in the groove portion 13 of the terminal holding portion 11. With this condition, there is secured a gap preventing each vertical wall 28*b* and protrusion 14 from firmly contacting each other, between the vertical wall 28*b* and protrusion 14. Further, between the cover body 12 and terminal holding portion 11 (more specifically between a top face 31 of the terminal holding portion 11 and a bottom face 32 of the cover body 12) is secured an appropriate gap which prevents contact of other portions than an edge 15*a* (see FIG. 5) of each lateral side wall 15 of the cover body 12.

With this condition, the cover body 12 is pressed by an ultrasonic horn so as to apply ultrasonic vibration (applying vertical vibration). Consequently, ultrasonic wave energy is concentrated on the protrusion 14 cooperating with the bottom wall 28*a* of the terminal 27 on a bottom 33 of the groove portion 13 to hold the covered wire therebetween, so that a cover portion of the covered wire is melted and then core elements 8*a* are exposed. The melted cover portion 8*b* is expelled from above the bottom wall 28*a* by pressing the protrusion 14, so that the core elements 8*a* and bottom wall 28*a* are conductively contacted with each other.

At this time, as shown in FIGS. 6B, 6C, the melted cover portion 8*b* escapes laterally through the cutout portions 29 provided in the vertical walls 28*b*, outside the bottom wall 28*a* of the terminal 27, that is, to gaps between the vertical walls 28*b* of the terminal 17 and the wall of the groove portion 13. Thus, the melted cover portion 8*b* can escape through various gaps and openings (29). The melted cover portion 8*b* is expelled from gaps between the core elements 8*a* and terminal 27 thereby making the core elements 8*a* and terminal 27 into excellent conductive contact with each other. Due to the presence of the vertical wall 28*b,* core elements 8*a* are prevented from being turned, flexed or displaced outside the terminal 27. Even when core elements 8a are flexed sideways together with the escaping melted cover portion 8*b,* they are brought into contact with the vertical wall(s) 28*b* so that they become conductive with the terminal 27. Thus from this point of view also, the conductivity performance is raised. Further because the melted cover portion 8*b* is distributed outside the terminal 27, a possibility of looseness between the terminal 27 and groove portion 13 is eliminated.

While preferred embodiments of the present invention have been described using specific terms, such description is for illustrative purposes, and it is to be understood that changes and variations may be made without departing from the spirit or scope of the following claims.

What is claimed is:

1. A terminal for ultrasonically connecting to a covered wire having a conductor and a cover portion covering the conductor, the terminal comprising:

a terminal portion including:

an opening portion for allowing the cover portion of the covered wire to laterally escape therethrough as the cover portion is melted by ultrasonic welding; and a blocking portion, disposed adjacent to the opening portion, having a contact surface for electrically contacting the conductor by the ultrasonic welding, and preventing the conductor on the contact surface from being moved through the opening with the melted cover portion.

2. The terminal of claim 1, wherein the terminal portion is a flat sheet, and wherein the opening portion is a plurality of concave portions, and the blocking portion is a plurality of convex portions.

3. The terminal of claim 1, wherein the terminal portion is U-shaped and has a bottom wall and lateral side walls, and the opening portion is a plurality of openings in the lateral side walls, and the blocking portion is parts of the lateral side walls between the plurality of openings.

4. An ultrasonic connection structure comprising:

a covered wire having a conductor and a cover portion covering the conductor, the cover portion being ultrasonically melted to expose the conductor; and a terminal having a wire connecting portion, the wire connecting portion including:

an opening portion for allowing a melted cover portion of the covered wire to laterally escape through;

a blocking portion having a contact surface for electrically contacting the exposed conductor, the blocking portion being disposed adjacent to the opening portion, the blocking portion preventing the exposed conductor from being laterally moving through the opening by the melted cover portion as the melted cover portion escapes through the opening portion.

5. The ultrasonic connection structure of claim 4, wherein the wire connecting portion of the terminal is disposed between a first connection member and a second connection member ultrasonically welded to each other under pressure.

6. The ultrasonic connection structure of claim 5, wherein the first connection member has a groove port and the second connection member has a protrusion to fit to the groove port with the wire connecting portion and the exposed conductor interposed therebetween.

7. An ultrasonic connection structure comprising:

an outer member having a plurality of members integrally formed by ultrasonic welding;

an electrically conductive member disposed in the outer member with a gap, the electrically conductive member including:

an electrically-conductive core element of a covered wire having a cover portion, the core element uncovered by ultrasonically melting the cover portion under pressure; and a terminal having a terminal portion with a contact surface for contacting the core element, the terminal portion having an opening formed in the contact surface, wherein the melted cover portion is disposed in the opening of the terminal portion and the gap.

8. An electrical connection structure comprising:

a conductive member including:

a conductor of a covered wire having a cover portion, the conductor being uncovered by ultrasonically melting the cover portion under pressure; and a terminal having a terminal portion, the terminal portion including a contact surface for contacting the conductor, and an opening formed in the contact surface;

a plurality of insulating members ultrasonically welded to each other under pressure, the conductive member being disposed between the plurality of insulating members, the plurality of insulating members including a melted cover of the cover portion filling the opening of the terminal portion.

* * * * *